US006130597A

United States Patent [19]

Toth et al.

[11] Patent Number: 6,130,597

[45] **Date of Patent: *Oct. 10, 2000**

[54] METHOD OF MAKING AN ELECTRICAL DEVICE COMPRISING A CONDUCTIVE POLYMER

[76] Inventors: James Toth, 107 Crestview Ct., San Carlos, Calif. 94070; Mark F. Wartenberg, 4612 Corrida Cir., San Jose, Calif. 95129; Mark Bannick, 3625 Eastridge Dr., San Jose, Calif. 95148

[ * ] Notice: This patent issued on a continued prosecution application filed under 37 CFR 1.53(d), and is subject to the twenty year patent term provisions of 35 U.S.C. 154(a)(2).

[21] Appl. No.: 08/798,887

[22] Filed: Feb. 10, 1997

Related U.S. Application Data

[63] Continuation of application No. 08/408,768, Mar. 22, 1995, abandoned.

[51] Int. Cl.[7] ..... H01C 7/10

[52] U.S. Cl. ..... 338/22 R; 29/612; 338/203

[58] Field of Search ..... 338/22 R, 22 S, 338/203, 235, 612; 219/504; 29/610.1

[56] References Cited

U.S. PATENT DOCUMENTS

| | | | |
|---|---|---|---|
| 4,200,973 | 5/1980 | Farkas et al. | 338/22 SD |
| 4,237,441 | 12/1980 | van Konynenburg et al. | 338/22 R |
| 4,388,607 | 6/1983 | Toy et al. | 338/22 SD |
| 4,514,620 | 4/1985 | Cheng et al. | 338/22 SD |
| 4,534,889 | 8/1985 | van Konynenburg et al. | 252/511 |
| 4,545,926 | 10/1985 | Fouts, Jr. et al. | 252/511 |
| 4,560,498 | 12/1985 | Horsma et al. | 252/511 |
| 4,591,700 | 5/1986 | Sopory | 219/505 |
| 4,689,475 | 8/1987 | Matthiesen et al. | 219/553 |
| 4,724,417 | 2/1988 | Au et al. | 338/22 R |
| 4,774,024 | 9/1988 | Deep et al. | 252/511 |
| 4,800,253 | 1/1989 | Kleiner et al. | 219/553 |
| 4,857,880 | 8/1989 | Au et al. | 338/22 SD |
| 4,907,340 | 3/1990 | Fang et al. | 29/610.1 |
| 4,935,156 | 6/1990 | van Konynenburg et al. | 219/553 |
| 5,049,850 | 9/1991 | Evans | 338/22 R |
| 5,089,801 | 2/1992 | Chan et al. | 338/22 R |
| 5,250,228 | 10/1993 | Baigrie et al. | 252/511 |
| 5,303,115 | 4/1994 | Nayar et al. | 361/106 |
| 5,378,407 | 1/1995 | Chandler et al. | 252/513 |
| 5,436,609 | 7/1995 | Chan et al. | 338/22 SD |
| 5,451,919 | 9/1995 | Chu et al. | 338/22 SD |

FOREIGN PATENT DOCUMENTS

| | | | |
|---|---|---|---|
| 0 311 142 | 4/1989 | European Pat. Off. | H01C 7/02 |
| 0 460 790 | 12/1991 | European Pat. Off. | H01B 1/24 |
| 0 484 138 | 5/1992 | European Pat. Off. | H01C 7/02 |
| WO 94/01876 | 1/1994 | WIPO . | |

OTHER PUBLICATIONS

Search Report for International Application No. PCT/US96/03469, dated Aug. 8, 1996.

U. S. application No. 07/910,950, Graves et al., filed Jul. 9, 1992.

U. S. application No. 08/121,717, Siden, filed Sep. 15, 1993.

U. S. application Serial No. 08/242,916, Zhang, filed May 13, 1994.

U. S. application No. 08/255,584, Chandler et al., filed Jun. 8, 1994.

U. S. application No. 08/257,586, Zhang, filed Jun. 9, 1994.

*Primary Examiner*—Michael L. Gellner
*Assistant Examiner*—Karl Easthon
*Attorney, Agent, or Firm*—Marguerite E. Gerstner; Herbert G. Burkard

[57] ABSTRACT

An electrical device in which a resistive element composed of a conductive polymer composition and two electrodes is made by a method in which the device is cut from a laminate of the conductive polymer composition and the electrodes, is exposed to a thermal treatment at a temperature above the melting temperature of the conductive polymer composition, and is then crosslinked.

17 Claims, 3 Drawing Sheets

METHOD OF MAKING AN ELECTRICAL DEVICE COMPRISING A CONDUCTIVE POLYMER

CROSS-REFERENCE TO RELATED APPLICATIONS

This application is a file wrapper continuation application of commonly assigned application Ser. No. 08/408,768, filed Mar, 22, 1995, now abandoned, the disclosure of which is incorporated herein by reference.

BACKGROUND OF THE INVENTION

1. Field of the Invention

This invention relates to electrical devices comprising conductive polymer compositions and methods for making such devices.

2. Introduction to the Invention

Electrical devices comprising conductive polymer compositions are well-known. Such compositions comprise a polymeric component and, dispersed therein, a particulate conductive filler such as carbon black or metal. Conductive polymer compositions are described in U.S. Pat. No. 4,237,441 (van Konynenburg et al), U.S. Pat. No. 4,388,607 (Toy et al), U.S. Pat. No. 4,534,889 (van Konynenburg et al), U.S. Pat. No. 4,545,926 (Fouts et al), U.S. Pat. No. 4,560,498 (Horsma et al), U.S. Pat. No. 4,591,700 (Sopory), U.S. Pat. No. 4,724,417 (Au et al), U.S. Pat. No. 4,774,024 (Deep et al), U.S. Pat. No. 4,935,156 (van Konynenburg et al), U.S. Pat. No. 5,049,850 (Evans et al), U.S. Pat. No. 5,250,228 (Baigrie et al), and U.S. Pat. No. 5,378,407 (Chandler et al), and in pending U.S. application Ser. Nos. 08/085,859 (Chu et al, filed Jun. 29, 1993) now U.S. Pat. No. 5,451,919, Ser. No. 08/255,497 (Chu et al, filed Jun. 8, 1994) now U.S. Pat. No. 5,582,770, and Ser. No. 08/408,769 (Wartenberg et al, filed Mar. U.S. Pat. No. 22, 1995), abandoned in favor of continuation application Ser. No. 08/789,962, filed Jan. 30, 1997, now U.S. Pat. No. 5,747,147, issued May 5, 1998. The disclosure of each of these patents and applications is incorporated herein by reference. These compositions often exhibit positive temperature coefficient (PTC) behavior, i.e. they increase in resistivity in response to an increase in temperature, generally over a relatively small temperature range. The size of this increase in resistivity is the PTC anomaly height.

PTC conductive polymer compositions are particularly suitable for use in electrical devices such as circuit protection devices that respond to changes in ambient temperature and/or current conditions. Under normal conditions, the circuit protection device remains in a low temperature, low resistance state in series with a load in an electrical circuit. When exposed to an overcurrent or overtemperature condition, however, the device increases in resistance, effectively shutting down the current flow to the load in the circuit. For many applications it is desirable that the device have as low a resistance and as high a PTC anomaly as possible. The low resistance means that there is little contribution to the resistance of the electrical circuit during normal operation. The high PTC anomaly allows the device to withstand the applied voltage. Although low resistance devices can be made by changing dimensions, e.g. making the distance between the electrodes very small or the device area very large, the most common technique is to use a composition that has a low resistivity. The resistivity of a conductive polymer composition can be decreased by adding more conductive filler, but this generally reduces the PTC anomaly. A possible explanation for the reduction of the PTC anomaly is that the addition of more conductive filler (a) decreases the amount of crystalline polymer that contributes to the PTC anomaly, or (b) physically reinforces the polymeric component and thus decreases the expansion at the melting temperature. It is, therefore, often difficult to achieve both low resistivity and high PTC anomaly.

SUMMARY OF THE INVENTION

Even when a low resistivity composition is prepared, the numerous processing steps required to fabricate a circuit protection device often contribute to an increase in device resistance. Processes that are used to improve the electrical stability of a device, e.g. crosslinking of the conductive polymer, or heat-treatment, often increase resistance. One common technique for preparing devices is to punch or cut devices from a sheet of conductive polymer laminated with metal electrodes. While it has been proposed in U.S. Pat. No. 5,303,115 (Nayar et al) that deliberately induced damage at the edges of specialized thick, highly crosslinked devices can be useful in meeting the requirements of a severe electrical test such as those set forth in Underwriter's Laboratory Standard 1459 (Jun. 5, 1990 and Dec. 13, 1991), we have now recognized that even routine punching processes on relatively thin devices can induce damage, e.g. microscopic cracks at the perimeter of the device. This damage decreases the PTC anomaly height and adversely affects electrical performance. There is, therefore, a need for a device that, after punching and processing, retains a low resistance and a high PTC anomaly, and exhibits good electrical stability.

We have now discovered that electrical devices with low resistance, high PTC anomaly, good electrical stability and reproducibility can be prepared by following a particular processing technique. In a first aspect, this invention discloses an electrical device which comprises (A) a resistive element which is composed of a conductive polymer composition which comprises
  (1) a polymeric component having a crystallinity of at least 20% and a melting point $T_m$, and
  (2) dispersed in the polymeric component a particulate conductive filler; and (B) two electrodes which (i) are attached to the resistive element, (ii) comprise metal foils, and (iii) can be connected to a source of electrical power, the device having been prepared by a method which comprises the steps of (a) cutting the device from a laminate comprising the conductive polymer composition positioned between two metal foils;

(b) exposing the device to a thermal treatment at a temperature $T_t$ which is greater than $T_m$ after the cutting step; and (c) crosslinking the conductive polymer composition after the thermal treatment step, said device having at least one of the following characteristics:

(i) a thickness of at most 0.51 mm;

(ii) a crosslinking level equivalent to 1 to 20 Mrads;

(iii) the crosslinking was accomplished in a single process;

(iv) a resistance at 20° C., $R_{20}$, of at most 1.0 ohm; and (v) a resistivity at 20° C., $\rho_{20}$, of at most 2.0 ohm-cm.

In a second aspect, the invention discloses an electrical device which comprises (A) a resistive element which (i) has a thickness of at most 0.51 mm, (ii) is crosslinked to the equivalent of at least 2 Mrads, and (iii) is composed of a conductive polymer composition which comprises (1) a polymeric component having a crystallinity of at least 20% and a melting point $T_m$, and (2) dispersed in the polymeric component a particulate conductive filler; and (B) two electrodes which (i) are attached to the resistive element, (ii) comprise metal foils, and (iii) can be connected to a source of electrical power, the device (a) having a resistance at 20° C., $R_{20}$, of at most 1.0 ohm, (b) having a resistivity at 20° C., $\rho_{20}$, of at most 2.0 ohm-cm, (c) having a PTC anomaly, PTC, from 20° C. to ($T_m$+5° C.) of at least $10^5$, and (d) having been prepared by a method in which (1) the device has been cut in a cutting step from a laminate comprising the conductive polymer composition positioned between two metal foils, and (2) the device has been exposed to a thermal treatment at a temperature $T_t$ which is greater than $T_m$ after the cutting step and before a crosslinking step.

In a third aspect, the invention discloses a method of making an electrical device which comprises (A) a resistive element which (i) has a thickness of at most 0.51 mm, (ii) is crosslinked to the equivalent of at least 2 Mrads, and (iii) is composed of a conductive polymer composition which comprises (1) a polymeric component having a crystallinity of at least 20% and a melting point $T_m$, and (2) dispersed in the polymeric component a particulate conductive filler; and (B) two electrodes which (i) are attached to the resistive element, (ii) comprise metal foils, and (iii) can be connected to a source of electrical power, said method comprising (a) preparing a laminate comprising the conductive polymer composition positioned between two metal foils, (b) cutting a device from the laminate, (c) exposing the device to a thermal treatment at a temperature $T_t$ which is greater than $T_m$, (d) cooling the device, and (e) crosslinking the device.

BRIEF DESCRIPTION OF THE DRAWING

The invention is illustrated by the drawing in which.

DETAILED DESCRIPTION OF THE INVENTION

Figure 1:
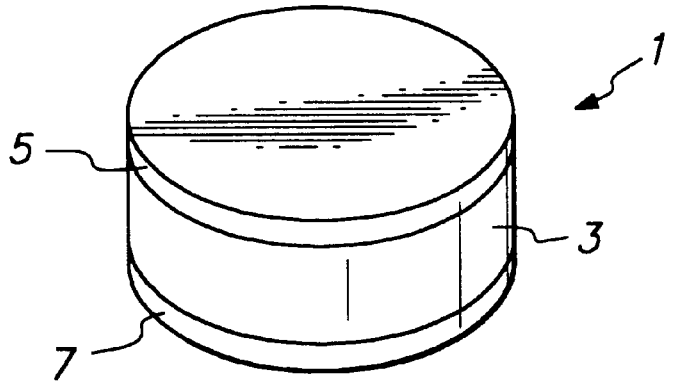
FIG. 1 shows a plan view of an electrical device of the invention.

The electrical device of the invention comprises a resistive element composed of a conductive polymer composition. This composition comprises a polymeric component comprising one or more crystalline polymers. The polymeric component has a crystallinity of at least 20%, preferably at least 30%, particularly at least 40%, as measured by a differential scanning calorimeter (DSC). It is preferred that the polymeric component comprise polyethylene, e.g. high density polyethylene, medium density polyethylene, low density polyethylene, or linear low density polyethylene; an ethylene copolymer or terpolymer, e.g. ethylene/acrylic acid copolymer (EAA), ethylene/ethyl acrylate (EEA), ethylene/butyl acrylate (EBA), or other copolymer such as those described in pending U.S. Pat. application Ser. No. 08/255,497 (Chu et al, filed Jun. 8, 1994) now U.S. Pat. No. 5,582,770, issued Dec. 10, 1996, the disclosure of which is incorporated herein by reference; a fluoropolymer, e.g. polyvinylidene fluoride (PVDF); or a mixture of two or more of these polymers. High density polyethylene that has a density of at least 0.94 g/cm$^3$, generally 0.95 to 0.97 g/cm$^3$, is particularly preferred. For some applications it may be desirable to blend the crystalline polymer(s) with one or more additional polymers, e.g. an elastomer or an amorphous thermoplastic polymer, in order to achieve specific physical or thermal properties, e.g. flexibility or maximum exposure temperature. The polymeric component generally comprises 40 to 80% by volume, preferably 45 to 75% by volume, particularly 50 to 70% by volume of the total volume of the composition. When the composition is intended for use in a circuit protection device that has a resistivity at 20° C. of at most 2.0 ohm-cm, it is preferred that the polymeric component comprise at most 70% by volume, preferably at most 66% by volume, particularly at most 64% by volume, especially at most 62% by volume of the total volume of the composition.

The polymeric component has a melting temperature, as measured by the peak of the endotherm of a differential scanning calorimeter, of $T_m$. When there is more than one peak, $T_m$ is defined as the temperature of the highest temperature peak.

Dispersed in the polymeric component is a particulate conductive filler. Suitable conductive fillers include carbon black, graphite, metal, e.g. nickel, metal oxide, conductive coated glass or ceramic beads, particulate conductive polymer, or a combination of these. Such particulate conductive fillers may be in the form of powder, beads, flakes, or fibers. It is preferred that the conductive filler comprise carbon black, and for compositions used in circuit protection devices it is particularly preferred that the carbon black have a DBP number of 60 to 120 cm$^3$/100 g, preferably 60 to 100 cm$^3$/100 g particularly 60 to 90 cm$^3$/100 g, especially 65 to 85 cm$^3$/100 g. The DBP number is an indication of the amount of structure of the carbon black and is determined by the volume of n-dibutyl phthalate (DBP) absorbed by a unit mass of carbon black. This test is described in ASTM D2414-93, the disclosure of which is incorporated herein by reference. The quantity of conductive filler needed is based on the required resistivity of the composition and the resistivity of the conductive filler itself. Generally the particulate conductive filler comprises 20 to 60% by volume, preferably 25 to 55% by volume, particularly 30 to 50% by volume of the total composition. If the composition is intended for use in a circuit protection device that has a resistivity at 20° C. of at most 2.0 ohm-cm, the conductive filler preferably comprises at least 30% by volume, particularly at least 34% by volume, especially at least 36% by volume, most especially at least 38% by volume of the total volume of the composition.

The conductive polymer composition may comprise additional components including antioxidants, inert fillers, nonconductive fillers, radiation crosslinking agents (often referred to as prorads or crosslinking enhancers), stabilizers, dispersing agents, coupling agents, acid scavengers (e.g. $CaCO_3$), or other components. These components generally comprise at most 20% by volume of the total composition.

The composition exhibits positive temperature coefficient (PTC) behavior, i.e. it shows a sharp increase in resistivity with temperature over a relatively small temperature range. The term "PTC" is used to mean a composition or device that has an $R_{14}$ value of at least 2.5 and/or an $R_{100}$ value of at least 10, and it is preferred that the composition or device should have an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. Compositions used for devices of the invention show a PTC anomaly over the range from 20° C. to ($T_m$+5° C.) of at least $10^4$, preferably at least $10^{4.5}$, particularly at least $10^5$, especially at least $10^{5.5}$, i.e. the log[(resistance at ($T_m$+5° C.)/resistance at 20° C.] is at least 4.0, preferably at least 4.5, particularly at least 5.0, especially at least 5.5. If the maximum resistance is achieved at a temperature $T_x$ that is below ($T_m$+5° C.), the PTC anomaly is determined by the log (resistance at $T_x$/resistance at 20° C.). In order to ensure that effects of processing and thermal history are neutralized, at least one thermal cycle from 20° C. to ($T_m$+5° C.) and back to 20° C. should be conducted before the PTC anomaly is measured.

While dispersion of the conductive filler and other components in the polymeric component may be achieved by any suitable means of mixing, including solvent-mixing, it is preferred that the composition be melt-processed using melt-processing equipment including mixers made by such manufacturers as Brabender, Moriyama, and Banbury, and continuous compounding equipment, such as co- and counter-rotating twin screw extruders. Prior to mixing, the components of the composition can be blended in a blender such as a Henschel™ blender to improve the uniformity of the mixture loaded into the mixing equipment. The composition can be prepared by using a single melt-mixing step, but it is often advantageous to prepare it by a method in which there are two or more mixing steps, as described in copending U.S. application Ser. No. 08/408,769 (Wartenberg et al, filed Mar. 22, 1995), abandoned in favor of continuation application Ser. No. 08/789,962, filed Jan. 30, 1997, now U.S. Pat. No. 5,747,147, issued May 5, 1998. During each mixing step the specific energy consumption (SEC), i.e. the total amount of work in MJ/kg that is put into the composition during the mixing process, is recorded. The total SEC for a composition that has been mixed in two or more steps is the total of each of the steps. Depending on the amount of particulate filler and polymeric component, a composition made by a multiple mixing process suitable for use in some devices of the invention, i.e. circuit protection devices, has a relatively low resistivity, i.e. less than 10 ohm-cm, preferably less than 5 ohm-cm, particularly less than 1 ohm-cm, while maintaining a suitably high PTC anomaly, i.e. at least 4 decades, preferably at least 4.5 decades.

After mixing, the composition can be melt-shaped by any suitable method, e.g. melt-extrusion, injection-molding, compression-molding, and sintering, in order to produce a resistive element. The element may be of any shape, e.g. rectangular, square, circular, or annular. For many applications, it is desirable that the composition be extruded into sheet from which the resistive element may be cut, diced, or otherwise removed. In one aspect of the invention, the resistive element has a thickness of at most 0.51 mm (0.020 inch), preferably at most 0.38 mm (0.015 inch), particularly at most 0.25 mm (0.010 inch), especially at most 0.18 mm (0.007 inch).

Electrical devices of the invention may comprise circuit protection devices, heaters, sensors, or resistors in which the resistive element is in physical and electrical contact with at least one electrode that is suitable for connecting the element to a source of electrical power. The type of electrode is dependent on the shape of the element, and may be, for example, solid or stranded wires, metal foils, metal meshes, or metallic ink layers. Electrical devices of the invention can have any shape, e.g. planar, axial, or dogbone, but particularly useful devices comprise two laminar electrodes, preferably metal foil electrodes, with the conductive polymer resistive element sandwiched between them. Particularly suitable foil electrodes have at least one surface that is electrodeposited, preferably electrodeposited nickel or copper. Appropriate electrodes are disclosed in U.S. Pat. No. 4,689,475 (Matthiesen), U.S. Pat. No. 4,800,253 (Kleiner et al), and pending U.S. application Ser. No. 08/255,584 (Chandler et al, Jun. 8, 1994), the disclosure of each of which is incorporated herein by reference. The electrodes may be attached to the resistive element by compression-molding, nip-lamination, or any other appropriate technique. Additional metal leads, e.g. in the form of wires or straps, can be attached to the foil electrodes to allow electrical connection to a circuit. In addition, elements to control the thermal output of the device, e.g. one or more conductive terminals, can be used. These terminals can be in the form of metal plates, e.g. steel, copper, or brass, or fins, that are attached either directly or by means of an intermediate layer such as solder or a conductive adhesive, to the electrodes. See, for example, U.S. Pat. No. 5,089,801 (Chan et al), and pending U.S. application Ser. No. 08/087,017 (Chan et al, filed Jul. 6, 1993), now U.S. Pat. No. 5,456,609. For some applications, it is preferred to attach the devices directly to a circuit board. Examples of such attachment techniques are shown in U.S. application Ser. No. 07/910,950 (Graves et al, filed Jul. 9, 1992), and U.S. Pat. No. 08/121,717 (Siden et al, filed Sep. 15, 1993), the disclosures of which are combined in continuation-in-part application Ser. No. 08/302,138 (filed Sep. 7, 1994), abandoned in favor of continuation application Ser. No. 08/727,869 (filed Oct. 8, 1996), which was abandoned in favor of continuation application Ser. No. 08/900,787 (filed Jul. 25, 1997), now U.S. Pat. No. 5,892,357, issued Dec. 22, 1998, and U.S. Pat. No. 08/242,916 (Zhang et al, filed May 13, 1994), abandoned in favor of continuation application Ser. No. 08/710,925 (filed Sep. 24, 1996), now U.S. Pat. No. 5,831,510, issued Nov. 3, 1998 and in International Application No. PCT/US93/06480 (Raychem Corporation, filed Jul. 8, 1993). The disclosure of each of these patents and applications is incorporated herein by reference.

In order to improve the electrical stability of the device, it is generally necessary to subject the resistive element to various processing techniques, e.g. crosslinking and/or heat-treatment, following shaping, before and/or after attachment of the electrodes. Crosslinking can be accomplished by chemical means or by irradiation, e.g. using an electron beam or a $Co^{60}$ γ irradiation source. The level of crosslinking depends on the required application for the composition, but is generally less than the equivalent of 200 Mrads, and is preferably substantially less, i.e. from 1 to 20 Mrads, preferably from 1 to 15 Mrads, particularly from 2 to 10 Mrads for low voltage (i.e. less than 60 volts) applications. Useful circuit protection devices for applications of less than 30 volts can be made by irradiating the device to at least 2 Mrads but at most 10 Mrads. Crosslinking may be accomplished in a single process.

We have found that substantially improved electrical stability and PTC anomaly can be achieved if, after the device is cut from a laminate comprising the conductive polymer composition positioned between two metal foils, the device is exposed to a thermal treatment before crosslinking of the conductive polymer composition is done. The device is first cut from the laminate in a cutting step. In this application, the term "cutting" is used to include any method of isolating or separating the resistive element of the device from the laminate, e.g. dicing, punching, shearing, cutting, etching and/or breaking as described in pending U.S. application Ser. No. 08/257,586 (Zhang et al, filed Jun. 9, 1994), abandoned in favor of continuation application Ser. No. 08/808,135 (filed Feb. 28, 1997), now U.S. Pat. No. 5,864,281, issued Jan. 26, 1999 the disclosure of which is incorporated herein by reference, or any other suitable means.

The thermal treatment requires that the device be subjected to a temperature $T_t$ that is greater than $T_m$, preferably at least ($T_m$+20° C.), particularly at least ($T_m$+50° C.), especially at least ($T_m$+70° C.). The duration of the thermal exposure may be very short, but is sufficient so that the entire conductive polymer in the resistive element reaches a temperature of at least ($T_m$+5° C.). The thermal exposure at $T_t$ is at least 0.5 seconds, preferably at least 1.0 second, particularly at least 1.5 seconds, especially at least 2.0 seconds. We have found that a suitable thermal treatment for devices made from high density polyethylene or ethylene/butyl acrylate copolymer may be achieved by dipping the device into a solder bath heated to a temperature of about 240 to 245° C., i.e. at least 100° C. above $T_m$, for a period of 1.5 to 2.5 seconds. Alternatively, good results have been achieved by passing the devices through an oven on a belt and exposing them to a temperature at least 100° C. above $T_m$ for 3 seconds. During either one of these processes, electrical leads can be attached to the electrodes by means of solder.

After exposure to the thermal treatment, the device is cooled to a temperature below $T_m$, i.e. to a temperature of at most ($T_m$−30° C.), preferably at most ($T_m$−50° C.), especially at most ($T_m$−70° C.). It is particularly preferred that the device be cooled to a temperature at which the conductive polymer composition has achieved 90% of it maximum crystallization. Cooling to room temperature, particularly to 20° C., is particularly preferred. The cooled device is then crosslinked, preferably by irradiation.

Devices of the invention are preferably circuit protection devices that generally have a resistance at 20° C., $R_{20}$, of less than 100 ohms, preferably less than 20 ohms, particularly less than 10 ohms, especially less than 5 ohms, most especially less than 1 ohm. It is particularly preferred that the device have a resistance of at most 1.0 ohm, preferably at most 0.50 ohm, especially at most 0.10 ohm, e.g. 0.001 to 0.100 ohm. The resistance is measured after one thermal cycle from 20° C. to ($T_m$+5° C.) to 20° C. Heaters generally have a resistance of at least 100 ohms, preferably at least 250 ohms, particularly at least 500 ohms.

When in the form of a circuit protection device, the device has a resistivity at 20° C., $\rho_{20}$, of at most 10 ohm-cm, preferably at most 2.0 ohm-cm, particularly at most 1.5 ohm-cm, more particularly at most 1.0 ohm-cm, especially at most 0.9 ohm-cm, most especially at most 0.8 ohm-cm. When the electrical device is a heater, the resistivity of the conductive polymer composition is generally substantially higher than for circuit protection devices, e.g. $10^2$ to $10^5$ ohm-cm, preferably $10^2$ to $10^4$ ohm-cm.

Devices made by the method of the invention show improvement in PTC anomaly over devices prepared by conventional methods in which the laminate is crosslinked before the device is cut. Thus a standard device is one made from the same composition as a device of the invention and following the same procedure, except that, for the standard device, the laminate was crosslinked before the cutting step. The resistivity $\rho_{20}$ for a device of the invention is less than $1.20\rho_{20c}$, preferably less than $1.15\rho_{20c}$, especially less than $1.10\rho_{20c}$, wherein $\rho_{20c}$ is the resistivity at 20° C. for a standard device measured following one thermal cycle from 20° C. to ($T_m$+5° C.) to 20° C. In addition, the PTC anomaly for a device of the invention is at least $1.15PTC_c$, preferably at least $1.20PTC_c$, particularly at least $1.25PTC_c$, especially at least $1.30PTC_c$, wherein $PTC_c$ is the PTC anomaly from 20° C. to ($T_m$+5° C.) for a standard device measured following one thermal cycle from 20° C. to ($T_m$+5° C.) to 20° C. Often devices of the invention have more than a 40% increase in PTC anomaly height with a relatively small, i.e. less than 20%, increase in resistivity at 20° C. The difference in resistivity for $\rho_{20}$, $\Delta\rho_{20}$, is determined from the formula [($\rho_{20}$ for a device of the invention—$\rho_{20}$ for a standard device)/($\rho_{20}$ for a device of the invention)]. The improvement for the PTC anomaly, ΔPTC, is determined from the formula [(PTC for a device of the invention—PTC for a standard device)/(PTC for a device of the invention)].

Devices of the invention also show improvement in performance in electrical tests such as cycle life, i.e. the stability of the device over time when subjected to a series of electrical tests that convert the device into a high resistance, high temperature state, and trip endurance, i.e. the stability of the device over time when powered into a high resistance, high temperature state.

The invention is illustrated by the drawing in which FIG. 1 shows an electrical device 1 of the invention. Resistive element 3, composed of a conductive polymer composition, is sandwiched between two metal foil electrodes 5,7.

Figure 2:
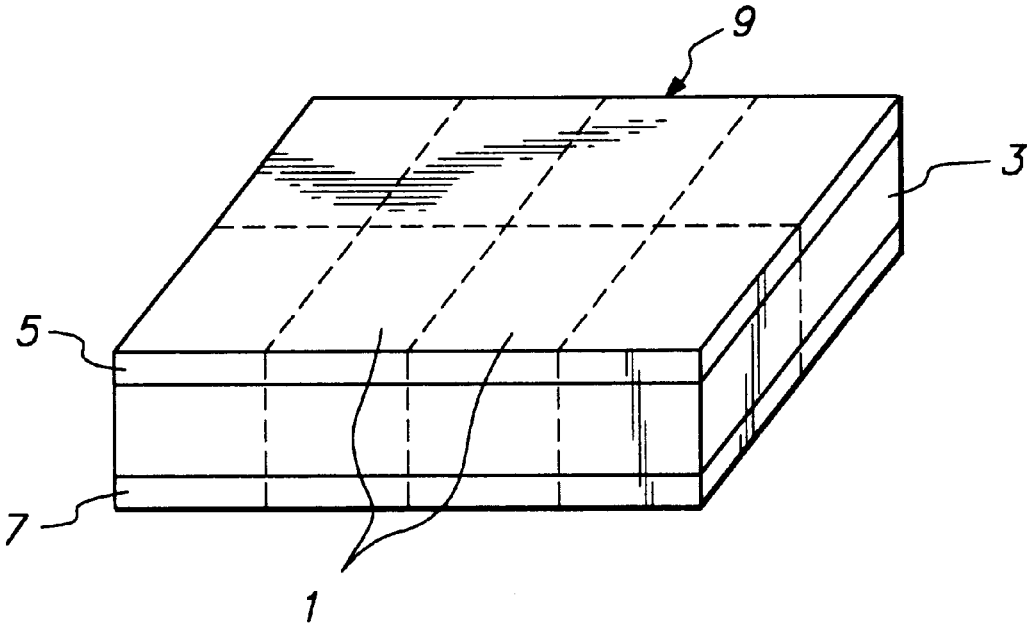
FIG. 2 shows a plan view of a laminate from which devices of the invention can be prepared.

FIG. 2 shows laminate 9 in which conductive polymer composition 3 is laminated to first and second metal foil electrodes 5,7. Individual electrical devices 1 can be cut or punched from laminate 9 along the dotted lines.

The invention is illustrated by the following examples, in which Example 1 and those devices prepared by Processes A, C, E, and G are comparative examples.

EXAMPLE 1 (Comparative)

Sixty percent by volume of powdered high density polyethylene (Petrothene™ LB832 which has a melting point of about 135° C., available from USI; HDPE) was preblended in a Henschel™ blender with 40% by volume carbon black beads (Raven™ 430 with a particle size of 82 nm, a structure (DBP) of 80 $cm^3$/100 g, and a surface area of 34 $m^2$/g, available from Columbian Chemicals; CB), and the blend was then mixed for 4 minutes in a 3.0 liter Moriyama mixer at 185° C. The mixture was cooled, granulated, and remixed three times for a total mix time of 16 minutes. The mixture was then compression-molded to give a sheet with a thickness of 0.18 mm (0.007 inch). The sheet was laminated between two layers of electrodeposited nickel foil having a thickness of about 0.033 mm (0.0013 inch) (available from Fukuda) by using a press set at 200° C. The laminate was irradiated to 10 Mrads using a 3.0 MeV electron beam, and chips with a diameter of 12.7 mm (0.5 inch) were punched from the laminate. Devices were formed from each chip by soldering 20 AWG tin-coated copper leads to each metal foil by dipping the chips into a solder formulation of 63% lead/37% tin heated to 245° C. for about 2.0 to 3.0 seconds, and allowing the devices to air cool. To determine the difference in the PTC anomaly height between the center of the device and the edge, a ferric chloride etch was used to remove the metal foil either from the center 6.25 mm (0.25 inch)-diameter section or from the outer 3.175 mm (0.125 inch) perimeter. The resistance versus temperature properties of the devices were determined by positioning the devices in an oven and measuring the resistance at intervals over the temperature range 20 to 160 to 20° C. Two temperature cycles were run. The height of the PTC anomaly was determined as log (resistance at 140° C./resistance at 20° C.) for the second cycle, and was recorded as $PTC_2$. The results are shown in Table I.

EXAMPLE 2

Devices were prepared according to the procedure of Example 1 except that chips were punched from the laminate and leads were attached by solder dipping prior to irradiating the devices to 10 Mrads. Results, as shown in Table I, indicate that devices that were soldered before irradiation, and that were exposed to a temperature during soldering that was higher than the melting temperature of the polymer, had higher PTC anomalies at both the center and edge regions.

EXAMPLE 3

Devices were prepared following the procedure of Example 2 except that prior to etching, the devices were punched again to give a diameter of 8.9 mm (0.35 inch). Etching was then done for either the 6.25 mm (0.25 inch) center or the outer 1.27 mm (0.05 inch) perimeter. The results, shown in Table I, indicate that thermal treatment gave good PTC anomaly height in the center, but that the subsequent punching produced edge damage that decreased the PTC anomaly height.

TABLE I

| Example | Process | $PTC_2$ Center (decades) | $PTC_2$ Edge (decades) |
|---|---|---|---|
| 1 | Irradiate/Punch/Solder | 5.0 | 4.7 |
| 2 | Punch/Solder/Irradiate | 6.0 | 6.0 |
| 3 | Punch/Solder/Irradiate/Punch | 6.3 | 3.4 |

EXAMPLES 4 AND 5

Sixty percent by volume of Petrothene™ LB832 was preblended with 40% by volume Raven™ 430, and the blend was then mixed for 16 minutes in a 60 $cm^3$ Brabender mixer. The mixture was granulated, and the granules were then compression-molded to give a sheet with the thickness specified in Table II. Using a press, the extrudate was laminated between two layers of electrodeposited nickel foil as in Example 1. Devices were then prepared using either the conventional process (Process A) or the process of the invention (Process B). Following the procedure described for Example 1, the PTC anomaly height was determined, and the resistivity at 20° C., $\rho_{20}$, was calculated. The results, shown in Table II, indicate that the PTC anomaly using Process B was substantially higher than that for Process A. In addition, the difference between the $\rho_{20}$value and the PTC anomaly for devices prepared by Process A and Process B was determined. The difference for $\rho_{20}$, $\Delta\rho_{20}$, was determined from the formula [($\rho_{20}$ for Process B—$\rho_{20}$ for Process A)/($\rho_{20}$ for Process B)]. The difference for the PTC anomaly, ΔPTC, was determined from the formula [(PTC for Process B—PTC for Process A)/(PTC for Process B)].

Process A (Conventional)

The laminate was irradiated to 10 Mrads using a 3.0 MeV electron beam, and chips with a diameter of 12.7 mm (0.5 inch) were punched from the laminate. Devices were formed from each chip by soldering 20 AWG tin-coated copper leads to each metal foil by dipping the chips into a solder formulation of 63% lead/37% tin heated to 245° C. for about 3.0 seconds, and allowing the devices to air cool.

Process B

Chips with a diameter of 12.7 mm (0.5 inch) were punched from the laminate and leads were attached to form a device by soldering 20 AWG tin-coated copper leads to each metal foil. Soldering was conducted by dipping the chips into a solder formulation of 63% lead/37% tin heated to 245° C. for about 3.0 seconds, and allowing the devices to air cool. The devices were then irradiated to 10 Mrads using a 3.0 MeV electron beam.

EXAMPLES 6 TO 9

Figure 3:
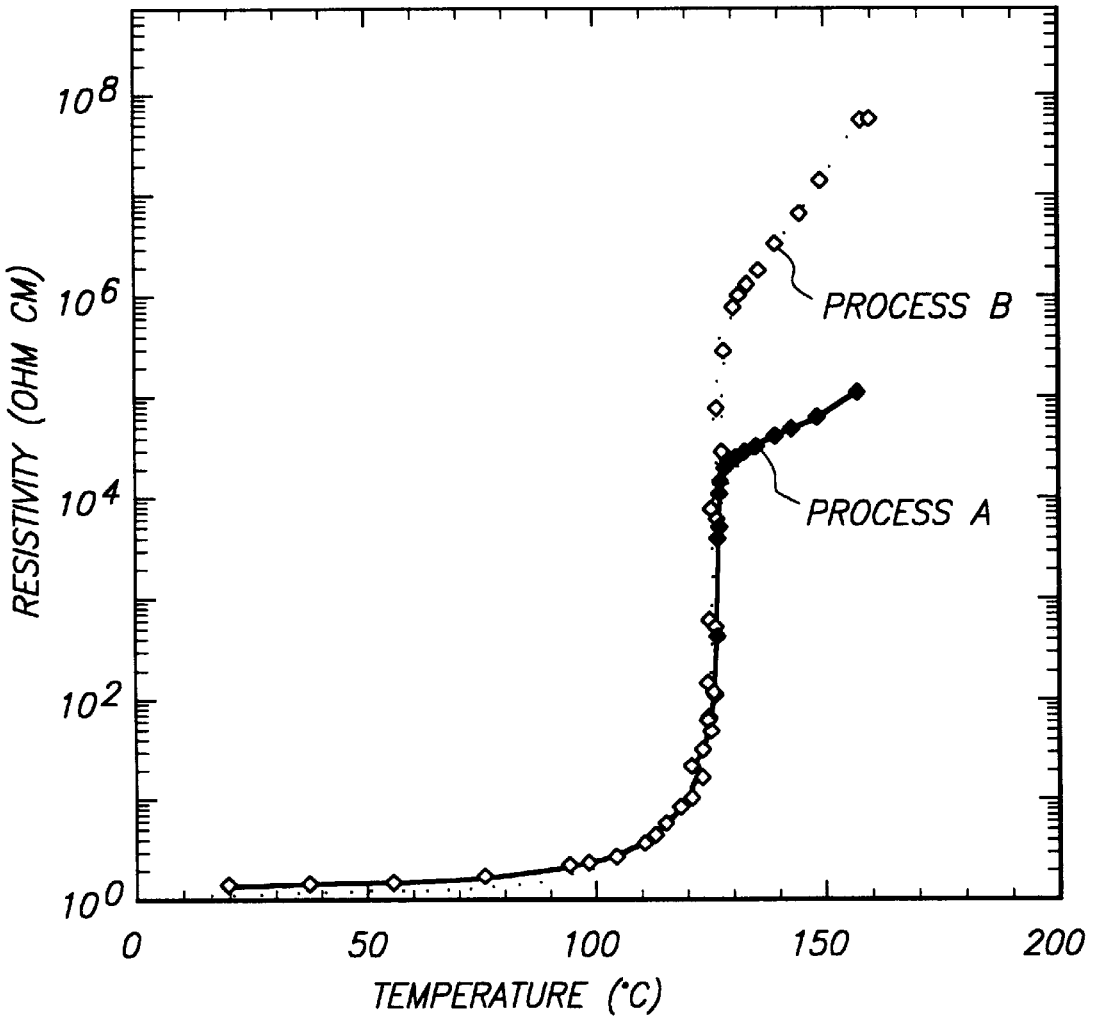
FIG. 3 shows the resistivity as a function of temperature for devices made by a conventional method and by the method of the invention.

Laminates of different thicknesses were prepared following the process of Example 1. Devices were prepared according to Process A or B. FIG. 3 shows the resistivity versus temperature curve for devices of Example 6 prepared by the conventional Process A, and by Process B, the process of the invention.

EXAMPLES 10 TO 12

Sixty-five percent by volume of Petrothene™ LB832 was preblended with 35% by volume Lampblack 101 (carbon black with a particle size of 95 nm, a DBP of 100 $cm^3$/100 g, a surface area of 20 $m^2$/g, available from Degussa) and the blend was then mixed for 16 minutes in a Moriyama mixer. The composition was extruded and devices were prepared according to Process A or B.

EXAMPLES 13 TO 15

The composition of Examples 10 to 12 was prepared by mixing in a 70 mm (2.75 inch) Buss kneader. The composition was compression-molded and devices were prepared according to Process A or B.

TABLE II

| | | Process A | | Process B | | | |
|---|---|---|---|---|---|---|---|
| Example | Thickness (mm) | $\rho_{20}$ (Ω-cm) | PTC (decades) | $\rho_{20}$ (Ω-cm) | PTC (decades) | $\Delta\rho_{20}$ (%) | Δ PTC (%) |
| 4 | 0.33 | 1.17 | 6.9 | 1.46 | 9.5 | 19.9 | 27.4 |
| 5 | 0.66 | 0.75 | 5.7 | 0.83 | 7.4 | 9.6 | 23.0 |
| 6 | 0.17 | 1.33 | 4.1 | 1.43 | 6.8 | 7.0 | 39.7 |
| 7 | 0.33 | 1.30 | 7.1 | 1.40 | 8.5 | 7.1 | 16.5 |
| 8 | 0.53 | 1.50 | 9.0 | 1.53 | 8.9 | 2.0 | −1.1 |
| 9 | 0.91 | 1.54 | 8.3 | 1.66 | 8.5 | 7.2 | 2.4 |
| 10 | 0.18 | 0.75 | 3.6 | 0.71 | 6.5 | −5.6 | 44.6 |
| 11 | 0.25 | 0.76 | 4.1 | 0.75 | 8.6 | −1.3 | 52.3 |
| 12 | 0.51 | 0.75 | 5.4 | 0.83 | 9.8 | 9.6 | 44.9 |
| 13 | 0.14 | 0.70 | 3.1 | 0.80 | 5.7 | 12.5 | 45.6 |
| 14 | 0.30 | 0.66 | 4.5 | 0.75 | 7.1 | 12.0 | 36.6 |
| 15 | 0.53 | 0.64 | 4.4 | 0.76 | 5.9 | 15.8 | 25.4 |

EXAMPLES 16 TO 22

The effect of exposing devices containing different amounts of carbon black to a thermal treatment was determined by preblending powdered Petrothene™ LB832 (HDPE) in a Henschel™ blender with Raven™ 430 in the amounts shown by volume percent in Table III. The blend was then mixed using a 70 mm (2.75 inch) Buss kneader to form pellets. For Example 21, the pellets of Example 20 were passed through the Buss kneader a second time. For Example 22, the pellets of Example 21 were passed through the Buss kneader a third time. The total amount of work used during the compounding process, i.e. the specific energy consumption (SEC) in MJ/kg, was recorded. The pellets for each composition were extruded through a sheet die to give a sheet with a thickness of 0.25 mm (0.010 inch). The extruded sheet was laminated as in Example 1. Devices were then prepared by either Process C (a conventional process) or D (a process of the invention).

Process C (Conventional)

The laminate was irradiated to 5 Mrads using a 3.0 MeV electron beam, and chips with a diameter of 12.7 mm (0.5 inch) were punched from the laminate. Devices were formed from each chip by soldering 20 AWG tin-coated copper leads to each metal foil by dipping the chips into a solder formulation of 63% lead/37% tin heated to 245° C. for about 1.5 seconds, and allowing the devices to air cool.

Process D

Chips with a diameter of 12.7 mm (0.5 inch) were punched from the laminate and leads were attached to form a device by soldering 20 AWG tin-coated copper leads to each metal foil. Soldering was conducted by dipping the chips into a solder formulation of 63% lead/37% tin heated to 245° C. for about 1.5 seconds, and allowing the devices to air cool. The devices were then irradiated to 5 Mrads using a 3.0 MeV electron beam.

The resistance versus temperature properties of the devices were determined by following the procedure of Example 1. Resistivity values were calculated from the recorded resistance at 20° C. on the first and second cycles, $\rho_1$ and $\rho_2$, respectively. The height of the PTC anomaly was determined as log(resistance at 140° C./resistance at 20° C.) for the first and second cycles, and was recorded in decades as $PTC_1$ and $PTC_2$, respectively. Also calculated were the difference between the resistivity value and the PTC anomaly for devices prepared by Process C and Process D for both the first and second cycles. The difference for the resistivity at 20° C. for the first cycle, $\Delta\rho_1$, was determined from the formula [($\rho_1$ for Process D—$\rho_1$ for Process C)/($\rho_1$ for Process D)]. The difference for the resistivity at 20° C. for the second cycle, $\Delta\rho_2$, was determined from the formula [($\rho_2$ for Process D—$\rho_2$ for Process C)/($\rho_1$ for Process D)]. The difference for the PTC anomaly for the first cycle, $\Delta PTC_1$, was determined from the formula [($PTC_1$ for Process D—$PTC_1$ for Process C)/($PTC_1$ for Process D)]. The difference for the PTC anomaly for the second cycle, $\Delta PTC_2$, was determined from the formula [($PTC_2$ for Process D—$PTC_2$ for Process C)/($PTC_2$ for Process D)]. The results, shown in Table III, indicate that the PTC anomaly for each composition for both the first and second thermal cycles was greater for the devices prepared by the process of the invention, i.e. Process D, than that for devices prepared by the conventional process, i.e. Process C. The difference was particularly marked for the second thermal cycle. For the second thermal cycle, although the resistivity was higher for the devices prepared by Process D, the resistivity increase was substantially less than the increase in PTC anomaly.

TABLE III

| Example | 16 | 17 | 18 | 19 | 20 | 21 | 22 |
|---|---|---|---|---|---|---|---|
| CB (Vol %) | 32 | 34 | 36 | 38 | 40 | 40 | 40 |
| HDPE (Vol %) | 68 | 66 | 64 | 62 | 60 | 60 | 60 |
| SEC (MJ/kg) | 2.52 | 2.48 | 3.06 | 3.31 | 3.64 | 6.01 | 8.96 |
| Process C | | | | | | | |
| $\rho_1$ (ohm-cm) | 2.02 | 1.27 | 0.98 | 0.76 | 0.58 | 0.65 | 0.76 |
| $PTC_1$ (decades) | 7.30 | 6.36 | 5.81 | 5.04 | 3.95 | 4.89 | 5.25 |
| $\rho_2$ (ohm-cm) | 2.08 | 1.34 | 1.02 | 0.81 | 0.56 | 0.67 | 0.73 |
| $PTC_2$ (decades) | 7.89 | 6.69 | 6.19 | 5.25 | 4.08 | 5.09 | 5.49 |
| Process D | | | | | | | |
| $\rho_1$ (ohm-cm) | 1.48 | 1.05 | 0.83 | 0.70 | 0.53 | 0.63 | 0.65 |
| $PTC_1$ (decades) | 8.39 | 7.86 | 7.38 | 6.27 | 4.54 | 5.79 | 6.50 |
| $\rho_2$ (ohm-cm) | 2.27 | 1.47 | 1.09 | 0.86 | 0.60 | 0.71 | 0.76 |
| $PTC_2$ (decades) | 8.86 | 8.29 | 7.65 | 6.39 | 4.58 | 5.95 | 6.74 |
| $\Delta\rho_1$ (%) | −36.4 | −21.0 | −18.1 | −8.6 | −9.4 | −3.2 | −16.9 |
| $\Delta PTC_1$ (%) | 13.0 | 19.1 | 21.2 | 19.6 | 13.0 | 15.5 | 19.2 |
| $\Delta\rho_2$ (%) | 8.4 | 8.8 | 6.4 | 5.8 | 6.7 | 5.6 | 3.9 |
| $\Delta PTC_2$ (%) | 10.9 | 19.3 | 19.1 | 17.8 | 10.9 | 14.5 | 18.5 |

EXAMPLES 23 TO 26

Following the procedure of Example 21, 61% by volume Petrothene LB832 was mixed with 39% by volume of Raven 430. The composition was extruded to give a sheet 0.30 mm (0.012 inch) thick, that was nip-laminated with two layers of electrodeposited nickel-copper foil (Type 31, having a thickness of 0.043 mm (0.0013 inch), available from Fukuda) to produce a laminate. Devices were then prepared by either Process E (a conventional process) or F (a process of the invention).

Process E (Conventional)

The laminate was irradiated to 10 Mrads using a 3.0 MeV electron beam, and chips with dimensions of 5.1×5.1 mm (0.2×0.2 inch) or 20×20 mm (0.8×0.8 inch) were sheared from the laminate. Devices were formed from each chip by soldering 20 AWG tin-coated copper leads to each metal foil by dipping the chips into a solder formulation of 63% lead/37% tin heated to 245° C. for about 2.5 seconds, and allowing the devices to air cool. The devices were encapsulated by dipping them into Hysol™ DK18-05 powdered epoxy, an epoxy resin-anhydride compound available from The Dexter Corporation containing 30 to 60% by weight fused silica, 2% antimony trioxide, 5 to 10% benzophenonetetracarboxylic dianhydride (BTDA), and 30 to 60% bis-A epoxy resin. The powder was cured at 155° C. for 2 hours. The devices were then thermally cycled six times, each cycle being from −40 to 85 to −40° C. at a rate of 5° C./minute with a 30 minute dwell at −40° C. and 85° C.

Process F

Chips with dimensions of 5.1×5.1 mm (0.2×0.2 inch) or 20×20 mm (0.8×0.8 inch) were sheared from the laminate. The chips were then heat-treated using a thermal profile in which the temperature increased from 20° C. to 240° C. in 11 seconds, remained at 240° C. for 3 seconds, and then decreased to 20° C. over 65 seconds. The chips were then irradiated, lead-attached, encapsulated, and thermally cycled as in Process E.

The resistance versus temperature properties were determined over the range of 20 to 140° C. for two cycles. The PTC anomaly was determined as log(resistance at 140° C./resistance at 20° C.) for both cycles and recorded as $PTC_1$ for the first cycle and $PTC_2$ for the second cycle. The results, shown in Table IV, indicate that the devices made by the conventional process had substantially less PTC anomaly than those made by the process of the invention. The electrical stability was determined by testing for cycle life and trip endurance, described below. The results indicated that, in general, the devices made by the process of the invention had improved resistance stability.

Cycle Life

Devices were tested in a circuit consisting of the device in series with a switch, a DC power supply of 16 volts, 24 volts, or 30 volts, and a fixed resistor that limited the initial current to 100A. Each cycle consisted of applying power to the circuit for 6 seconds to trip the device into the high resistance state, and then turning the power off for 120 seconds. At intervals, the voltage was removed, the devices were cooled for one hour, and the resistance at 20° C. was measured. The normalized resistance, $R_N$, i.e. (the resistance at 20° C. measured at each interval/the initial resistance at 20° C.), was reported.

Trip Endurance

Devices were tested in a circuit consisting of the device in series with a switch, a DC power supply of either 16 volts or 30 volts, and a fixed resistor that limited the initial current to 40A. The device was tripped into the high resistance state and removed periodically. After each interval, the device was allowed to cool for one hour and the resistance at 20° C. was measured. The normalized resistance, $R_N$, was reported.

TABLE IV

| Example | | 23 | 24 | 25 | 26 |
|---|---|---|---|---|---|
| Size (mm) | | 5.1 × 5.1 | 5.1 × 5.1 | 20 × 20 | 20 × 20 |
| Process | | E | F | E | F |
| Resistance (mΩ) | | 70.9 | 82.1 | 4.41 | 4.77 |
| $PTC_1$ (decades) | | 5.0 | 7.2 | 5.1 | 7.2 |
| $PTC_2$ (decades) | | 4.9 | 7.5 | 5.1 | 7.4 |
| Cycle Life $R_N$ | | | | | |
| 16 V: | 100 cycles | 1.07 | 1.00 | 1.10 | 1.02 |
| | 500 cycles | 3.04 | 1.30 | 1.11 | 1.00 |
| | 1000 cycles | 3.31 | 2.00 | 1.16 | 1.00 |
| | 2000 cycles | 5.34 | 3.84 | 1.28 | 1.04 |
| 24 V: | 100 cycles | 1.15 | 1.32 | 1.05 | 1.00 |
| | 500 cycles | 1.57 | 1.56 | 1.07 | 0.96 |
| | 1000 cycles | 2.20 | 2.12 | 1.11 | 1.04 |
| | 2000 cycles | 3.59 | 4.18 | 1.20 | 1.10 |
| 30 V: | 100 cycles | 1.44 | 1.22 | 1.09 | 1.04 |
| | 500 cycles | | 1.63 | 1.10 | 1.01 |
| | 1000 cycles | | 1.81 | 1.17 | 1.07 |
| | 2000 cycles | | 3.10 | 1.25 | 1.11 |
| Trip endurance $R_N$ | | | | | |
| 16 V: | 5 minutes | 1.23 | 1.22 | 1.26 | 1.15 |
| | 24 hours | 1.35 | 1.21 | 1.35 | 1.16 |
| | 96 hours | 1.68 | 1.45 | 1.53 | 1.25 |
| | 366 hours | 2.78 | 2.31 | 2.00 | 1.57 |
| | 723 hours | 4.23 | 3.39 | 2.71 | 1.89 |
| 30 V: | 5 minutes | 1.31 | 1.26 | 1.34 | 1.16 |
| | 24 hours | 2.04 | 1.32 | 1.60 | 1.24 |
| | 96 hours | 2.59 | 1.82 | 1.71 | |
| | 366 hours | 10.6 | 3.54 | 2.23 | 1.63 |
| | 723 hours | 595 | 7.56 | 2.93 | 1.98 |

EXAMPLES 27 AND 28

Sixty-four percent by volume of ethylene/n-butyl acrylate copolymer (Enathene™ EA 705-009, containing 5% n-butyl acrylate, having a melt index of 3.0 g/10 min, a melting temperature of 105° C., available from Quantum Chemical Corporation) was preblended with 36% by volume Raven™ 430, and the blend was then mixed for 12 minutes in a 350 $cm^3$ Brabender mixer heated to 175° C. The mixture was granulated, the granules were extruded into a sheet, and the sheet was laminated in a press between two layers of Type 31 foil. Devices of Example 27 were prepared by Process G (a conventional process); devices of Example 28 were prepared by Process H (a process of the invention).

Process G (Conventional)

The laminate was irradiated to 10 Mrads using a 3.0 MeV electron beam and chips with dimensions of 5.1×12.1×0.23 mm (0.2×0.475×0.009 inch) were cut from the laminate. Devices were formed by soldering 20 AWG leads as in Process E. Device resistance at 20° C. was 0.071 ohms.

Process H

Chips with dimensions of 5.1×12.1×0.23 mm (0.2×0.475×0.009 inch) were cut from the laminate. Leads were attached as in Process E and the devices were then heat-treated by exposure to 290° C. in a reflow oven for about 3.5 seconds. After cooling to room temperature, the devices were irradiated to 10 Mrads using a 3 MeV electron beam. Device resistance at 20° C. was 0.096 ohms.

Figure 4:
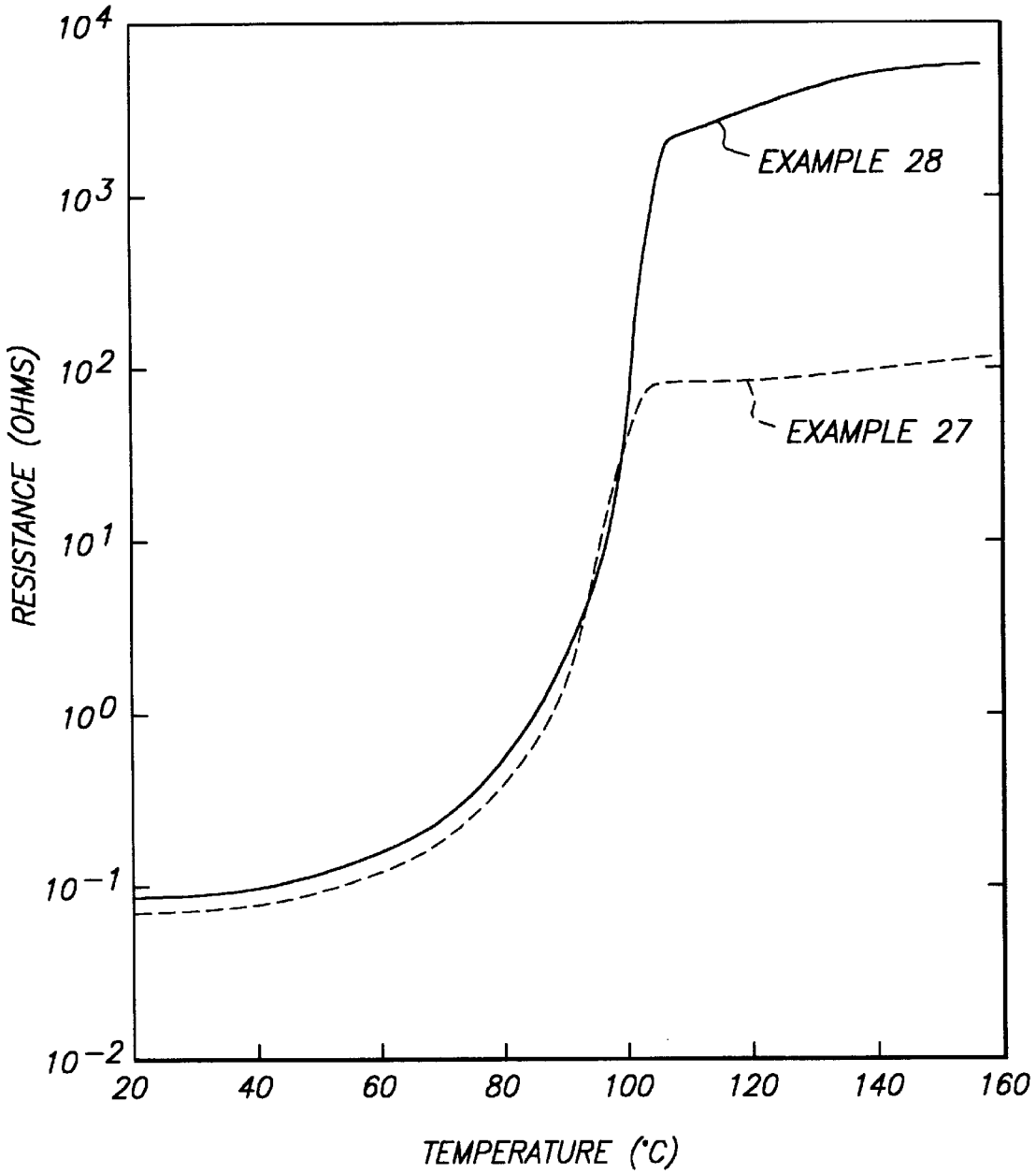
FIG. 4 shows the resistance as a function of temperature for devices made by a conventional method and by the method of the invention.

FIG. 4 shows a curve of the resistance in ohms as a function of temperature for Examples 27 and 28. It is apparent that a device made by the process of the invention has substantially higher PTC anomaly than a device made by a conventional processes.

What is claimed is:

1. A method of making an electrical device suitable for use in applications of less than 60 volts which comprises (A) a resistive element which (i) has a thickness of at most 0.51 mm, (ii) is crosslinked to the equivalent of 1 to 20 Mrads by irradiation, and (iii) is composed of a conductive polymer composition which comprises (1) a polymeric component having a crystallinity of at least 20% and a melting point $T_m$, and (2) dispersed in the polymeric component a particulate conductive filler which consists essentially of carbon black; and (B) two electrodes which (i) are attached to the resistive element, (ii) comprise metal foils, and (iii) are suitable for connection to a source of electrical power, said method comprising the steps of (a) preparing a laminate comprising the conductive polymer composition positioned between two metal foils, (b) cutting a device from the laminate, (c) exposing the device to a thermal treatment at a temperature $T_t$ which is greater than $T_m$, (d) cooling the device, and (e) crosslinking the device in a single irradiation step, said irradiation step being the only irradiation step, steps (a) to (e) being conducted in sequence.

2. A method according to claim 1 wherein $T_t$ is at least ($T_m$+20° C.).

3. A method according to claim 2 wherein $T_t$ is at least ($T_m$+50° C.).

4. A method according to claim 1 wherein during step (c) electrical leads are attached to the electrodes.

5. A method according to claim 4 wherein attachment is achieved by means of solder.

6. An electrical device made by the method of claim 1 which has a resistance at 20° C., $R_{20}$, of at most 1.0 ohm.

7. A device according to claim 6 wherein the thickness of the resistive element is at most 0.25 mm.

8. A device according to claim 6 which has a resistance of at most 0.100 ohm.

9. A device according to claim 6 which has a PTC anomaly from 20° C. to ($T_m$+5° C.) of at least $10^{4.0}$.

10. A device according to claim 9 which has a PTC anomaly of at least $10^{45}$.

11. A device according to claim 6 wherein the polymeric component comprises polyethylene, an ethylene copolymer, or a fluoropolymer.

12. A device according to claim 11 wherein the polymeric component comprises high density polyethylene.

13. A device according to claim 11 wherein the polymeric component comprises ethylene/butyl acrylate copolymer.

14. A device according to claim 6 wherein the device has been crosslinked to the equivalent of 2 to 10 Mrads.

15. An electrical device made by the method of claim 1 which has a resistivity at 20° C., $P_{20}$, of at most 2.0 ohm-cm.

16. A device according to claim 15 which has a resistivity of at most 1.0 ohm-cm.

17. A device according to claim 15 wherein $\rho_{20}$ is less than $1.2\rho_{20c}$ and PTC is at least 1.1 $5PTC_c$, wherein $\rho_{20c}$ is the resistivity at 20° C. for a standard device and $PTC_c$ is the PTC anomaly from 20° C. to ($T_m$+5° C.) for the standard device, said standard device comprising the same composition as said electrical device and having been prepared by the same method as said electrical device except that step (e) to crosslink the device is performed before step (b) to cut the device from laminate.

* * * * *